US011828145B2

(12) United States Patent
Al Arji et al.

(10) Patent No.: US 11,828,145 B2
(45) Date of Patent: Nov. 28, 2023

(54) ELECTRICAL SUBMERSIBLE PUMP FOR A WELLBORE

(71) Applicant: Saudi Arabian Oil Company, Dhahran (SA)

(72) Inventors: Faisal M. Al Arji, Al Qatif (SA); Ali F. Al Khamees, Al Qatif (SA); Fares A. Al Yami, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/511,743

(22) Filed: Oct. 27, 2021

(65) Prior Publication Data

US 2023/0129694 A1 Apr. 27, 2023

(51) Int. Cl.

| | |
|---|---|
| ***E21B 43/12*** | (2006.01) |
| ***E21B 33/12*** | (2006.01) |
| ***F04B 47/06*** | (2006.01) |
| ***F04B 51/00*** | (2006.01) |
| ***E21B 17/02*** | (2006.01) |

(52) U.S. Cl.

CPC ..... *E21B 43/128* (2013.01); *E21B 17/028* (2013.01); *E21B 33/12* (2013.01); *F04B 47/06* (2013.01); *F04B 51/00* (2013.01)

(58) Field of Classification Search

CPC ..... E21B 43/128; E21B 17/028; E21B 33/12; F04B 47/06; F04B 51/00

See application file for complete search history.

(56) References Cited

U.S. PATENT DOCUMENTS

| | | | | |
|---|---|---|---|---|
| 4,266,607 A * | 5/1981 | Halstead | ..... | E21B 43/128 166/371 |
| 6,545,221 B1 * | 4/2003 | Halpert | ..... | E21B 17/206 166/65.1 |
| 6,598,681 B1 * | 7/2003 | Berry | ..... | E21B 43/128 166/62 |

(Continued)

FOREIGN PATENT DOCUMENTS

| | | | | |
|---|---|---|---|---|
| CA | 2846748 | 3/2013 | | |
| GB | 2254656 A * | 10/1992 | ..... | E21B 43/128 |
| WO | WO 2017115094 | 7/2017 | | |

OTHER PUBLICATIONS

Harris et al., "Design and Qualification Testing of ESP Cable to Improve ESP System Run Life," SPE Gulf Coast Section Electric Submersible Pumps Symposium, 2019, 15 pages.

*Primary Examiner* — Steven A MacDonald
(74) *Attorney, Agent, or Firm* — Fish & Richardson P.C.

(57) ABSTRACT

A downhole pumping system includes a downhole pump that includes a motor and is configured to circulate a downhole fluid from a subterranean reservoir to a terranean surface; a production tubing string positioned in the wellbore from the terranean surface to the subterranean reservoir and fluidly coupled to the downhole pump; a wellbore seal positioned in the wellbore and configured to fluidly isolate a first portion of an annulus that is uphole of the downhole pump from a second portion of the annulus in which the downhole pump is positionable; and a pump power cable electrically connected to the motor and to a power source cable in the first portion of the annulus with a power connector, where each of the pump power cable and the power source cable includes a metal jacket that encapsulates the respective cable.

17 Claims, 4 Drawing Sheets

(56) References Cited

U.S. PATENT DOCUMENTS

| | | | | |
|---|---|---|---|---|
| 7,971,650 | B2 | 7/2011 | Yuratich et al. | |
| 8,997,852 | B1 * | 4/2015 | Lee | E21B 43/12 166/105 |
| 9,074,592 | B2 | 7/2015 | Morrison et al. | |
| 9,970,250 | B2 | 5/2018 | Hess et al. | |
| 10,439,393 | B2 * | 10/2019 | Caiafa | H02J 3/007 |
| 11,025,059 | B2 * | 6/2021 | Caiafa | H02J 3/003 |
| 2007/0295504 | A1 * | 12/2007 | Patel | E21B 47/006 322/14 |
| 2009/0183870 | A1 * | 7/2009 | Leitch | E21B 43/128 166/244.1 |
| 2012/0269660 | A1 | 10/2012 | Yin et al. | |
| 2013/0272906 | A1 | 10/2013 | Head | |
| 2015/0037171 | A1 * | 2/2015 | Orrego | E21B 43/128 417/423.3 |
| 2016/0258231 | A1 * | 9/2016 | Naumann | E21B 17/003 |
| 2020/0208473 | A1 * | 7/2020 | Biddick | E21B 17/028 |
| 2021/0246771 | A1 * | 8/2021 | Ejim | E21B 43/128 |

* cited by examiner

ELECTRICAL SUBMERSIBLE PUMP FOR A WELLBORE

TECHNICAL FIELD

The present disclosure describes apparatus, systems, and methods associated with an electrical submersible pump (ESP) for a wellbore.

BACKGROUND

An electrical submersible pump (ESP) is one of many types of pumps that can be used in a well to circulate hydrocarbon fluids to the surface. In some cases, an ESP is connected with a rubber power cable from a terranean surface. The power cable goes through an annulus of a wellbore and into a packer through built-in rubber-to-metal connectors. Often, certain components of an ESP system, including power cables, can deteriorate in the wellbore environment, which can include corrosive fluids.

SUMMARY

In an example implementation, a downhole pumping system includes a downhole pump that includes a motor and is configured to be positioned in a wellbore that extends from a terranean surface into a subterranean reservoir, the downhole pump configured to circulate a downhole fluid from the subterranean reservoir to the terranean surface; a production tubing string positioned in the wellbore from the terranean surface to the subterranean reservoir and fluidly coupled to the downhole pump, the production tubing string defining an annulus between the production tubing string and the wellbore; a wellbore seal positioned in the wellbore and configured to fluidly isolate a first portion of the annulus that is uphole of the downhole pump from a second portion of the annulus in which the downhole pump is positionable; and a pump power cable electrically connected to the motor and to a power source cable in the first portion of the annulus with a power connector, each of the pump power cable and the power source cable including a metal jacket that encapsulates the respective cable.

In an aspect combinable with the example implementation, the power connector includes a metal-to-metal connector.

In another aspect combinable with any of the previous aspects, the pump power cable includes a first pump power cable, the power source cable includes a first power source cable, and the power connector includes a first power connector.

Another aspect combinable with any of the previous aspects further includes a second pump power cable electrically connected to the motor and to a second power source cable in the first portion of the annulus with a second power connector, each of the second pump power cable and the second power source cable including a metal jacket that encapsulates the respective second cable.

In another aspect combinable with any of the previous aspects, the second power source cable is electrically coupled to the second pump power cable independently of the first power source cable being electrically coupled to the first pump power cable.

In another aspect combinable with any of the previous aspects, the first pump power cable is electrically connected to the motor at a first motor power connection, and the second pump power cable is electrically connected to the motor at a second motor power connection different than the first motor power connection.

In another aspect combinable with any of the previous aspects, the metal jacket includes a stainless steel jacket.

In another aspect combinable with any of the previous aspects, the metal jacket includes a plurality of metal jacket sections that are connected to form the metal jacket.

In another aspect combinable with any of the previous aspects, the plurality of metal jacket sections are threadingly coupled together.

In another example implementation, a method for circulating a wellbore fluid includes running a downhole pump that includes a motor into a wellbore that extends from a terranean surface into a subterranean reservoir; positioning the downhole pump adjacent the subterranean reservoir; fluidly coupling the downhole pump to a production tubing string positioned in the wellbore from the terranean surface to the subterranean reservoir; installing a wellbore seal in an annulus of the wellbore defined between the production tubing string and the wellbore to fluidly isolate a first portion of the annulus uphole of the downhole pump from a second portion of the annulus in which the downhole pump is positioned; providing electric power from a power source cable to a pump power cable electrically connected to the motor and through a power connector that electrically connects the power source cable to the pump power cable in the first portion of the annulus, each of the pump power cable and the power source cable including a metal jacket that encapsulates the respective cable; and operating the powered downhole pump to circulate a wellbore fluid from the subterranean reservoir into the production tubing string.

In an aspect combinable with the example implementation, the power connector includes a metal-to-metal connector.

In another aspect combinable with any of the previous aspects, the pump power cable includes a first pump power cable, the power source cable includes a first power source cable, and the power connector includes a first power connector.

Another aspect combinable with any of the previous aspects further includes detecting a loss of the electric power provided from the first power source cable to the first pump power cable and through the first power connector; and providing electric power from a second power source cable to a second pump power cable electrically connected to the motor and through a second power connector that electrically connects the second power source cable to the second pump power cable in the first portion of the annulus, each of the second pump power cable and the second power source cable including a metal jacket that encapsulates the respective second cable.

In another aspect combinable with any of the previous aspects, detecting the loss of the electric power includes detecting a stop of operation of the downhole pump.

In another aspect combinable with any of the previous aspects, the second power source cable is electrically coupled to the second pump power cable independently of the first power source cable being electrically coupled to the first pump power cable.

In another aspect combinable with any of the previous aspects, the first pump power cable is electrically connected to the motor at a first motor power connection, and the second pump power cable is electrically connected to the motor at a second motor power connection different than the first motor power connection.

In another aspect combinable with any of the previous aspects, the metal jacket includes a stainless steel jacket.

In another aspect combinable with any of the previous aspects, the metal jacket includes a plurality of metal jacket sections that are connected to form the metal jacket.

In another aspect combinable with any of the previous aspects, the plurality of metal jacket sections are threadingly coupled together.

In another example implementation, an electrical submersible pump (ESP) system includes an ESP that includes an electric motor and is configured to be positioned in a wellbore that extends from a terranean surface into a subterranean reservoir, the ESP configured to circulate a downhole fluid from the subterranean reservoir to the terranean surface; a production tubing string positioned in the wellbore from the terranean surface to the subterranean reservoir and fluidly coupled to the ESP, the production tubing string defining an annulus between the production tubing string and the wellbore; a packer positioned in the wellbore and configured to fluidly isolate a first portion of the annulus uphole of the ESP from a second portion of the annulus in which the ESP is positionable; a first power cabling configured to electrically couple the electric motor to a source of electric power positioned on the terranean surface, the first power cabling including at least one first conductor encapsulated in a first metal jacket; and a second power cabling configured to electrically couple the electric motor to the source of electric power positioned on the terranean surface, the second power cabling including at least one second conductor encapsulated in a second metal jacket.

In an aspect combinable with the example implementation, each of first and second power cabling includes a metal-to-metal power connector positioned in the first portion of the annulus.

In another aspect combinable with any of the previous aspects, the second power cabling is electrically coupled to the electric motor independently of the first power cabling being electrically coupled to the electric motor.

In another aspect combinable with any of the previous aspects, the first power cabling is electrically connected to the electric motor at a first motor power connection, and the second power cabling is electrically connected to the electric motor at a second motor power connection independent of the first motor power connection.

In another aspect combinable with any of the previous aspects, the first and second metal jackets include stainless steel jackets.

Implementations of a downhole pump system according to the present disclosure may include one or more of the following features. For example, a downhole pump system according to the present disclosure can eliminate power cable connectors positioned through a wellbore seal, such as a packer, which can reduce ESP premature failures. As another example, a downhole pump system according to the present disclosure can include a primary and secondary power cabling, each of which can be fully encapsulated with a metal jacket up to the surface to provide a complete isolation system instead of downhole insulation. Such as complete isolation can eliminate a possibility of sour and corrosive fluids to be in contact with a conductor (e.g., a copper alloy) inside the power cabling and therefore increase a run life of an ESP system. As a further example, a downhole pump system according to the present disclosure can utilize identical components for the power cabling to reduce cost and provide a back-up to maintain and prolong production in case of an ESP failure in a first power cabling. For instance, a second power cabling can save a considerable amount of time and cost as it can maintain production and can eliminate the need for ESP replacement by a rig.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
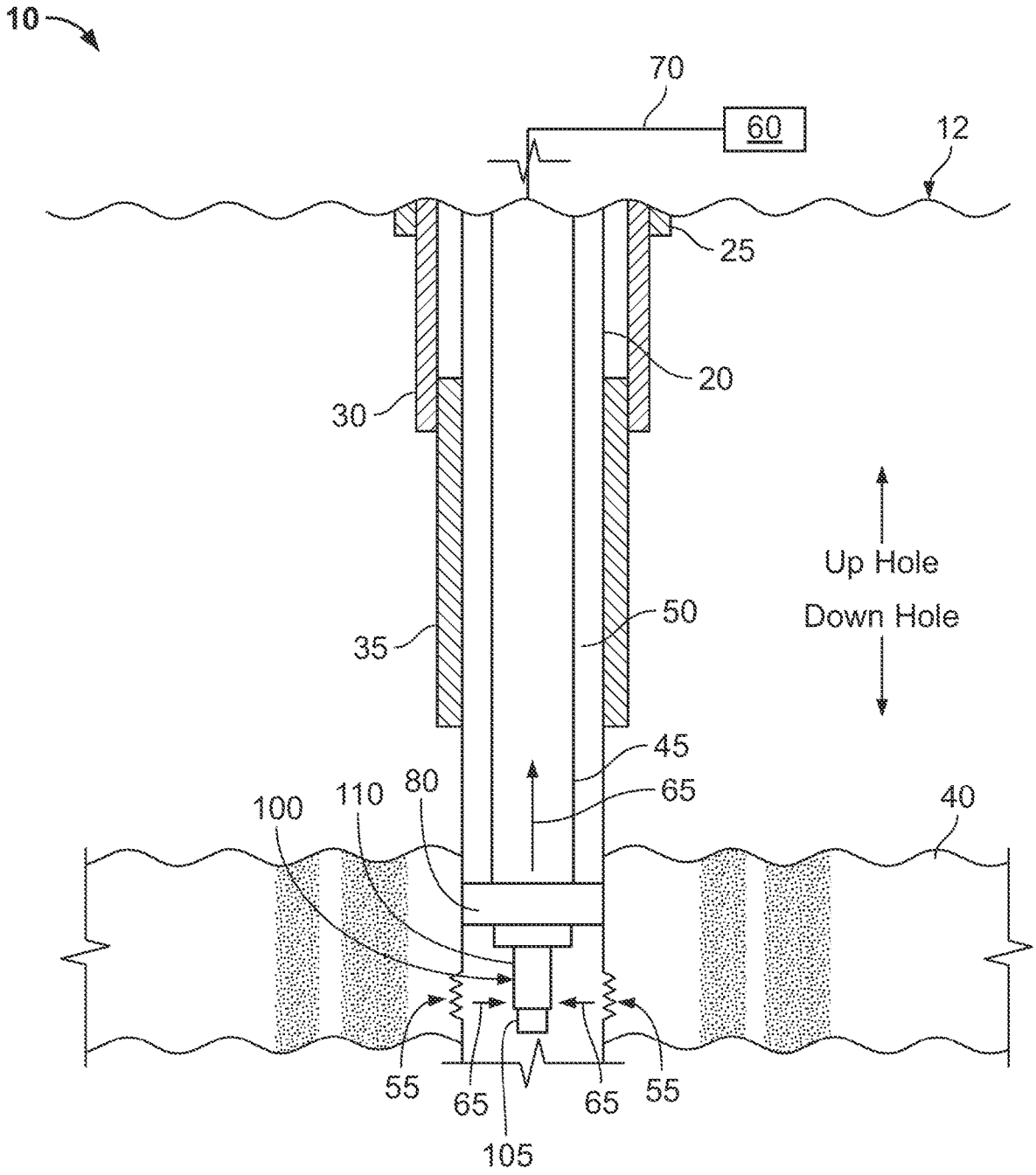
FIG. 1 is a schematic diagram of an example implementation of a downhole pump system according to the present disclosure.

FIG. 1 is a schematic diagram of an example implementation of a downhole pumping system 10 including a downhole pump assembly 100. Generally, FIG. 1 illustrates at least a portion of one implementation of the downhole pumping system 10 according to the present disclosure in which the downhole pump assembly 100 may be run into a wellbore 20 on a wellbore tubular 45 (for example, a production string 45) within the wellbore 20. In this example, an uphole end of the downhole pump assembly 100 is coupled to the production string 45 while the downhole pump assembly 100 is positioned adjacent a subterranean reservoir 40.

In this example implementation, the downhole pump assembly 100 comprises an electric submersible pump (ESP) 100 that is operable to circulate a wellbore fluid 65, such as a hydrocarbon fluid (for example, oil, gas, or a mixture thereof) from the subterranean reservoir 40 to a terranean surface 12 (as described in more detail with reference to FIG. 2). In some aspects, the ESP 100, as shown, is positioned on the production string 45 below a wellbore seal 80 (for example, a packer or other seal) that is positioned in the wellbore 20. An annulus 50 is defined between the production string 45 and the wellbore 20.

Figure 2:
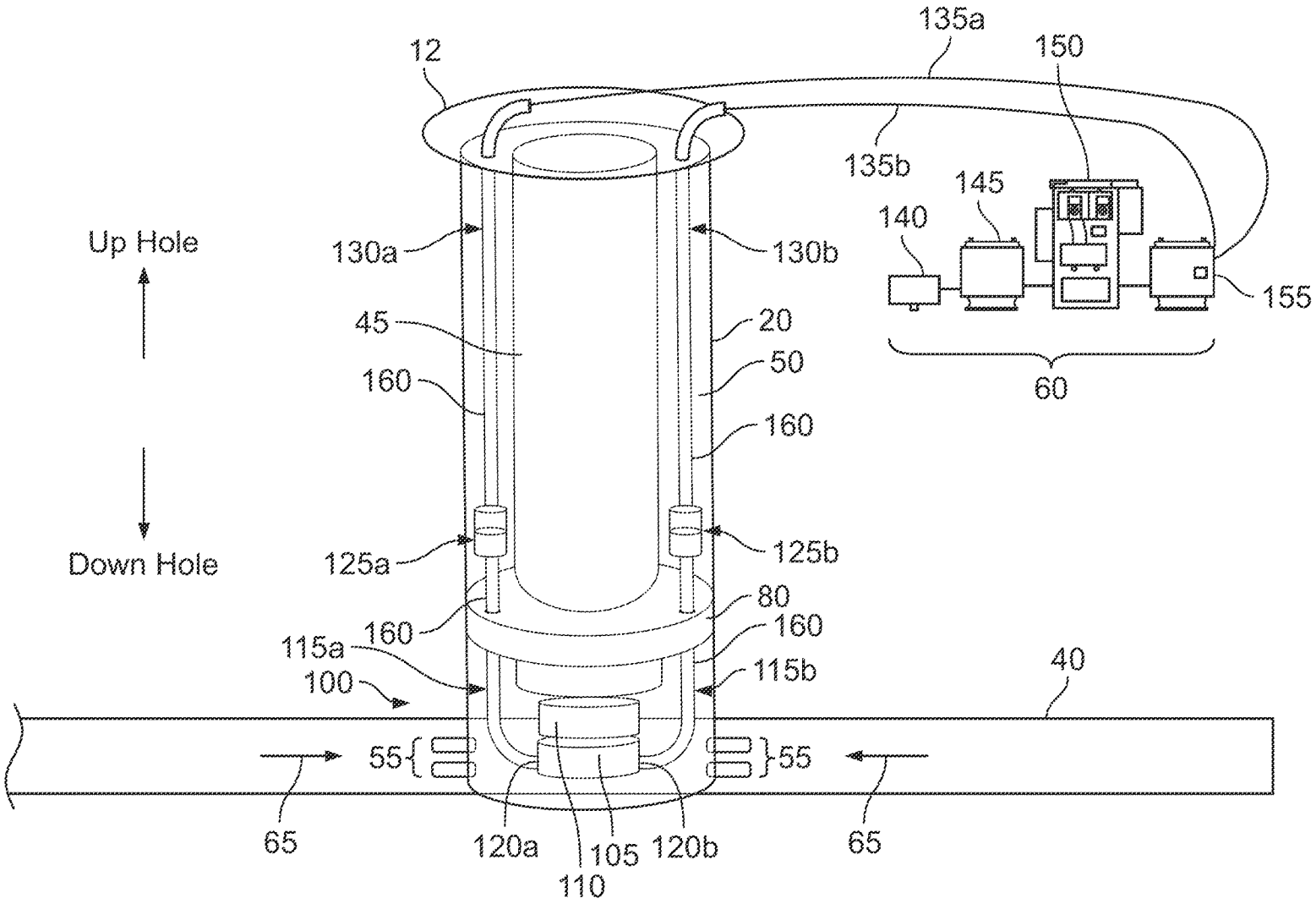
FIG. 2 is a schematic diagram of an example implementation of a downhole electrical submersible pump (ESP) according to the present disclosure.

As described more fully with reference to FIG. 2, in some aspects, the ESP 100 can be configured to have an extended operational life, as well as minimize shutdowns to maintain production of the wellbore fluid 65 from the subterranean reservoir 40 to the terranean surface 12. For example, one or more power cables 70 that provide electrical power to the ESP 100 from a power supply system 60 at the terranean surface 12 can be fully encapsulated with a metal jacket between the ESP 100 and the terranean surface 12 (and in some cases, to the power supply system 60) to avoid direct exposure of the one or more power cables 70 to downhole conditions, such as corrosive wellbore fluids. In some aspects, the ESP 100 can include a power connection (for example, within or to the one or more power cables 70) externally of, and uphole of, the wellbore seal 80 to reduce pump failures. In some aspects, the one or more power cables 70 comprises at least two power cables 70 configured in a primary and secondary power cable arrangement. In some aspects, each of the at least two power cables 70 are electrically coupled independently to an electric motor of the ESP 100.

As shown, the downhole pumping system 10 accesses the subterranean formation 40 and provides access to hydrocarbons (for example, the wellbore fluid 65) located in such subterranean formation 40. In an example implementation of system 10, the system 10 may be used for a production operation in which the hydrocarbons may be produced from the subterranean formation 40 through the downhole pump assembly 100 and to the wellbore tubular 45 (for example, as a production tubing or casing) uphole of the downhole pump assembly 100. The tubular 45 may represent any tubular member positioned in the wellbore 20 such as, for example, coiled tubing, any type of casing, a liner or lining, a work string (in other words, multiple tubulars threaded together), or other form of tubular member.

A drilling assembly (not shown) may be used to form the wellbore 20 extending from the terranean surface 12 and through one or more geological formations in the Earth. One or more subterranean formations, such as subterranean zone 40, are located under the terranean surface 12. As will be explained in more detail below, one or more wellbore casings, such as a surface casing 30 and intermediate casing 35, may be installed in at least a portion of the wellbore 20. In some implementations, a drilling assembly used to form the wellbore 20 may be deployed on a body of water rather than the terranean surface 12. For instance, in some implementations, the terranean surface 12 may be an ocean, gulf, sea, or any other body of water under which hydrocarbon-bearing formations may be found. In short, reference to the terranean surface 12 includes both land and water surfaces and contemplates forming and developing one or more downhole pumping systems 10 from either or both locations.

In some implementations of the downhole pumping system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some implementations, the wellbore 20 may be offset from vertical (for example, a slant wellbore). Even further, in some implementations, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the intermediate casing 35. Any of the illustrated casings, as well as other casings that may be present in the downhole pumping system 10, may include one or more casing collars.

In this example implementation of the downhole pumping system 10, the downhole pump assembly 100 includes a pump 110 coupled to an electric motor 105 (for example, that collectively form the ESP 100). In this example, the wellbore seal 80 is set just uphole of one or more perforations 55 (for example, made in a casing of the wellbore 20) that fluidly couple the subterranean reservoir 40 to the wellbore 20. The electric motor 105 can be operated by electric power provided by the two or more power cables 70 (that extend within the annulus 50 to electrically connect with the motor 105 as described in more detail with reference to FIG. 2). Upon activation, for example by the power supply system 60, the electric motor 105 activates the pump 110 to circulate the wellbore fluid 65 through the perforations 55, into one or more inlets of the pump 110, and into the production string 45 toward the terranean surface 12 as shown.

FIG. 2 is a schematic diagram of an example implementation of the downhole pump assembly 100 according to the present disclosure. In this example implementation, the downhole pump assembly 100 includes or is an electrical submersible pump (ESP) that is positioned in the wellbore 20 as shown. As with the implementation shown in FIG. 1, the pump assembly 100 is positioned on the production string 45 within the wellbore 20 and adjacent one or more perforations 55 made in the wellbore 20 (in other words, in a casing) near the subterranean reservoir 40. The wellbore seal 80 (for example, packer 80) is positioned in the wellbore 20 ad fluidly couples a portion of the annulus 50 that is uphole from wellbore seal 80 from another portion of the annulus 50 that is downhole of the wellbore seal 80 where the downhole pump 100 is positioned as shown in FIG. 2. Thus, when the wellbore seal 80 is engaged with the wellbore 20 (or casing installed in the wellbore 20), any wellbore fluid 65 that flows into the wellbore 20 downhole of the wellbore seal 80 can only flow to the terranean surface 12 (as pumped by the downhole pump 100) within the production string 45 (in other words, not the annulus 50).

As shown in this example, motor power cables 115*a* and 115*b* are electrically coupled to the motor 105 at connection points 120*a* and 120*b*, respectively. Thus, in this example, each motor power cable 115*a* and 115*b* is independently coupled to the motor 105 respective to the other motor power cable. In some aspects, each motor power cable 115*a* and 115*b* comprises a conductor (e.g., one or more copper wires or other form of conductor) that is encapsulated by a metal jacket 160.

In this example implementation, each motor power cable 115*a* and 115*b* is also electrically coupled to a respective power source cable 130*a* and 130*b*. Much like the motor power cables, the power source cables 130*a* and 130*b* can include a conductor (e.g., one or more copper wires or other form of conductor) that is represented by conductors 135*a* and 135*b* that is encapsulated by a metal jacket 160. The motor power cables 115*a* and 115*b* are electrically coupled to power source cables 130*a* and 130*b*, respectively, at power connections 125*a* and 125*b*. In this example, each power connection 125*a* and 125*b* is located in the portion of the annulus 50 uphole of the wellbore seal 80. Thus, in this example, each power connection 125*a* and 125*b* should be located in a portion of the annulus 50 that experiences less corrosive wellbore fluid 65 than, for example, the portion of the annulus 50 downhole of the wellbore seal 80.

As shown in the example implementation of FIG. 2, conductors 135*a* and 135*b* extend from the respective power source cables 130*a* and 130*b* above terranean surface 12 and connect to power supply system 60. In this example implementation of FIG. 2, the power supply system 60 includes, for example, a junction box 140 that is electrically coupled to a source of electric power (for example, power grid, generator renewable source, etc.), a transformer 145 that, in some aspects, transforms high voltage (for example, 13.5 kV) to medium voltage (for example, 480 V), a controller 150, and a variable frequency drive (VFD) 155. In this example, the VFD 155 is electrically coupled to the motor 105 of the downhole pump 100 to initiate operation of, and adjust a speed of, the pump 110.

In this example implementation, the downhole pump 100 is supplied electrical power by a primary electrical cabling, for example, the power source cable 130*a* connected to the electric motor 105 at connection 120*a* through the power connection 125*a* and motor power cable 115*a*. The downhole pump 100 is also supplied electrical power by a secondary, or backup, electrical cabling, for example, the power source cable 130*b* connected to the electric motor 105 at connection 120*b* through the power connection 125*b* and motor power cable 115*b*. In alternative implementations, the primary and secondary electrical power cablings can be switched. In some aspects, the primary electrical cabling provides electrical power to the motor 105 at all operational times, and the secondary, or backup, electrical cabling only supplies electrical power to the motor 105 upon a fault or loss of power in the primary electrical cabling (for example, as detected by the controller 150 or VFD 155). In some aspects, the primary electrical cabling and secondary electrical power cabling alternatingly provide electrical power to the motor 105 during operational times as controlled by the controller 150 or VFD 155.

In this example implementation, each electrical cabling (for example, the primary electrical cabling and the secondary electrical cabling) is fully encapsulated with a metal jacket 160 (such as stainless steel or other corrosion-resistant metal) to prevent, for instance, corrosion of the conductors 135*a* and 135*b*, as well as allow pressure testing of the wellbore 20. For example, the metal-to-metal connection can facilitate the ability to pressure test the wellbore system, which can serve as a way to check the overall integrity of the system.

Further, each power connection 125*a* and 125*b* can comprise a metal-to-metal connection such that no portion of the connection or conductors are exposed to any wellbore fluids 65. As fully encapsulated electrical power cabling, premature failures after pump deployment and recurring electrical failures in pump motors and/or cables can be reduced or avoided.

Figure 3:
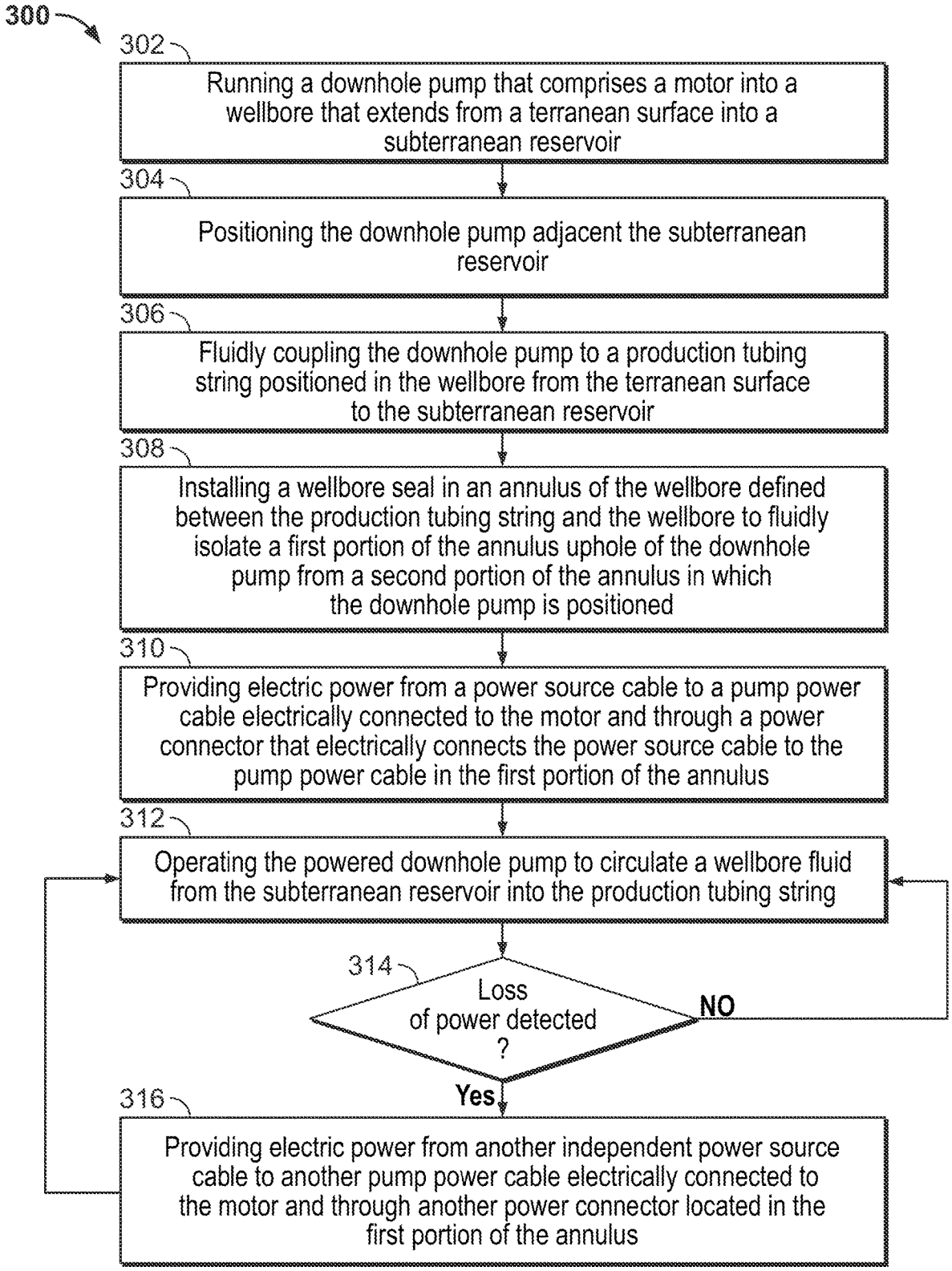
FIG. 3 is a flowchart of an example method performed with or by an example implementation of a downhole pump system including a downhole ESP according to the present disclosure.

FIG. 3 is a flowchart of an example method 300 performed with or by an example implementation of a downhole pump system including a downhole pump according to the present disclosure. For instance, method 300 may be performed with or by the downhole pump system 10 and downhole pump 200 shown in FIGS. 1-2, respectively.

Method 300 can begin at step 302, which includes running a downhole pump that comprises a motor into a wellbore that extends from a terranean surface into a subterranean reservoir. For example, downhole pump assembly (or ESP) 100 can be run into the wellbore 20 on the production string 45 from the terranean surface 12. In some aspects, the motor 105 of the downhole pump 100 is coupled to the pump 110 and is electrically coupled through motor power cable 115*a* and 115*b*, power connections 125*a* and 125*b*, and power source cables 130*a* and 130*b* to the power supply system 60 as the downhole pump assembly 100 is run into the wellbore 20.

Method 300 can continue at step 304, which includes positioning the downhole pump adjacent the subterranean reservoir. For example, once the downhole pump assembly 100 is positioned at or near the subterranean reservoir 40 (and, for example, adjacent or near perforations 55), the downhole pump assembly 100 and production string 45 can be positioned.

Method 300 can continue at step 306, which includes fluidly coupling the downhole pump to a production tubing string positioned in the wellbore from the terranean surface to the subterranean reservoir. For example, once the downhole pump assembly 100 is positioned in the wellbore 20, the pump 110 can be operated (for example, to open one or more inlet openings or valves) to fluidly coupled the pump assembly 100 to the subterranean formation 40 within the wellbore 20.

Method 300 can continue at step 308, which includes installing a wellbore seal in an annulus of the wellbore defined between the production tubing string and the wellbore to fluidly isolate a first portion of the annulus uphole of the downhole pump from a second portion of the annulus in which the downhole pump is positioned. For example, once positioned (and in some aspects, prior to step 306), the wellbore seal 80 (for example, an inflatable packer) can be actuated to seal against the wellbore 20 (or casing installed in the wellbore 20). By sealing against the wellbore 20 (or casing installed in the wellbore 20), the wellbore seal 80 defines a portion of the annulus 50 uphole of the wellbore seal 80 that is fluidly decoupled (except through the downhole pump assembly 100 and the production string 45) from a portion of the annulus 50 that is downhole of the wellbore seal 80.

Method 300 can continue at step 310, which includes providing electric power from a power source cable to a pump power cable electrically connected to the motor and through a power connector that electrically connects the power source cable to the pump power cable in the first portion of the annulus. For example, during normal operation, electric power is supplied from the power supply system 60 (into conductor 135*a*), through the power source cable 130*a*, through the power connection 125*a*, into the motor power cable 115*a*, and to the electric motor 105 at connection 120*a*.

Method 300 can continue at step 312, which includes operating the powered downhole pump to circulate a wellbore fluid from the subterranean reservoir into the production tubing string. For example, once powered, the downhole pump assembly 100 can circulate (for example, at a constant speed of the motor 105 or a variable speed of the motor 105) the wellbore fluid 65 into the pump 110 and through the production string 45.

Method 300 can continue at step 314, which includes a determination of whether there is a loss of power to the electric motor that is detected. For example, if there is a loss of power within one or more of conductor 135*a*, power source cable 130*a*, power connection 125*a*, motor power cable 115*a*, or connection 120*a*, a determination of "yes" is made at step 314, and method 300 can continue at step 316. Step 316 includes providing electric power from another independent power source cable to another pump power cable electrically connected to the motor and through another power connector located in the first portion of the annulus. For example, at step 316, electric power is supplied from the power supply system 60 (into conductor 135*b*), through the power source cable 130*b*, through the power connection 125*b*, into the motor power cable 115*b*, and to the electric motor 105 at connection 120*b*. Method 300 can then revert to step 312.

If the determination in step 314 is "no," then method 300 can revert to step 312. Of course, steps 312-316 can be repeated more than once in method 300 as electrical power may need to be switched between power cabling.

Figure 4:
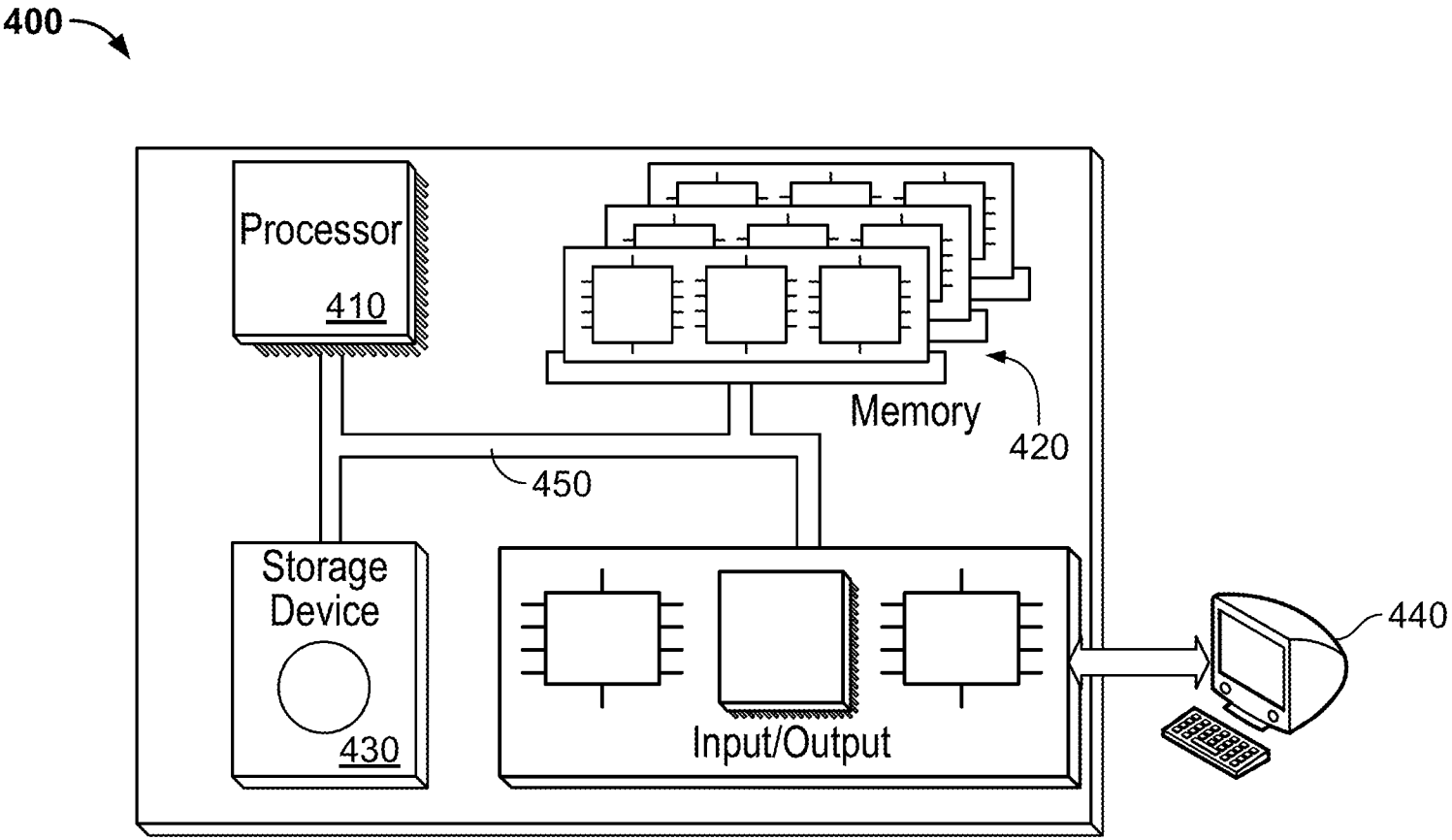
FIG. 4 is a schematic illustration of an example controller (or control system) for operating a downhole pump system according to the present disclosure.

FIG. 4 is a schematic illustration of an example controller 400 (or control system) for operating a downhole pumping system, such as all or a portion of downhole pumping system 10 of FIG. 1. For example, all or parts of the controller 400 can be used for the operations described previously, for example as or as part of the controller 150. The controller 400 is intended to include various forms of digital computers, such as printed circuit boards (PCB), processors, digital circuitry, or otherwise. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 400 includes a processor 410, a memory 420, a storage device 430, and an input/output device 440. Each of the components 410, 420, 430, and 440 are interconnected using a system bus 450. The processor 410 is capable of processing instructions for execution within the controller 400. The processor may be designed using any of a number of architectures. For example, the processor 410 may be a CISC (Complex Instruction Set Computers) processor, a RISC (Reduced Instruction Set Computer) processor, or a MISC (Minimal Instruction Set Computer) processor.

In one implementation, the processor 410 is a single-threaded processor. In another implementation, the processor 410 is a multi-threaded processor. The processor 410 is capable of processing instructions stored in the memory 420 or on the storage device 430 to display graphical information for a user interface on the input/output device 440.

The memory 420 stores information within the controller 400. In one implementation, the memory 420 is a computer-readable medium. In one implementation, the memory 420 is a volatile memory unit. In another implementation, the memory 420 is a non-volatile memory unit.

The storage device 430 is capable of providing mass storage for the controller 400. In one implementation, the storage device 430 is a computer-readable medium. In various different implementations, the storage device 430 may be a floppy disk device, a hard disk device, an optical disk device, a tape device, flash memory, a solid state device (SSD), or a combination thereof.

The input/output device 440 provides input/output operations for the controller 400. In one implementation, the input/output device 440 includes a keyboard and/or pointing device. In another implementation, the input/output device 440 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, solid state drives (SSDs), and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) or LED (light-emitting diode) monitor for displaying information to the user and a keyboard and a pointing device such as a mouse or a trackball by which the user can provide input to the computer. Additionally, such activities can be implemented via touchscreen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A method for circulating a wellbore fluid, comprising:

running a downhole pump that comprises a motor into a wellbore that extends from a terranean surface into a subterranean reservoir;

positioning the downhole pump adjacent the subterranean reservoir;

fluidly coupling the downhole pump to a production tubing string positioned in the wellbore from the terranean surface to the subterranean reservoir;

installing a wellbore seal in an annulus of the wellbore defined between the production tubing string and the wellbore to fluidly isolate a first portion of the annulus uphole of the downhole pump from a second portion of the annulus in which the downhole pump is positioned;

providing electric power from a first power source cable to a first pump power cable electrically connected to the motor and through a first power connector that electrically connects the first power source cable to the first pump power cable in the first portion of the annulus, each of the first pump power cable and the first power source cable comprising a metal jacket that encapsulates the respective cable;

operating the powered downhole pump to circulate a wellbore fluid from the subterranean reservoir into the production tubing string;

detecting a loss of the electric power provided from the first power source cable to the first pump power cable and through the first power connector; and providing electric power from a second power source cable to a second pump power cable electrically connected to the motor and through a second power connector that electrically connects the second power source cable to the second pump power cable in the first portion of the annulus, each of the second pump power cable and the second power source cable comprising a metal jacket that encapsulates the respective second cable.

2. The method of claim 1, wherein the power connector comprises a metal-to-metal connector.

3. The method of claim 1, further comprising installing the wellbore seal in the annulus of the wellbore defined between the production tubing string and the wellbore to fluidly isolate the first portion of the annulus uphole of the wellbore seal and the downhole pump from the second portion of the annulus in which the downhole pump is positioned.

4. The method of claim 1, wherein detecting the loss of the electric power comprises detecting a stop of operation of the downhole pump.

5. The method of claim 1, wherein the second power source cable is electrically coupled to the second pump power cable independently of the first power source cable being electrically coupled to the first pump power cable.

6. The method of claim 5, wherein the first pump power cable is electrically connected to the motor at a first motor power connection, and the second pump power cable is electrically connected to the motor at a second motor power connection different than the first motor power connection.

7. The method of claim 1, wherein the metal jacket comprises a stainless steel jacket.

8. The method of claim 1, wherein the metal jacket comprises a plurality of metal jacket sections that are connected to form the metal jacket.

9. The method of claim 8, wherein the plurality of metal jacket sections are threadingly coupled together.

10. A downhole pumping system, comprising:

a downhole pump that comprises a motor and is configured to be positioned in a wellbore that extends from a terranean surface into a subterranean reservoir, the downhole pump configured to circulate a downhole fluid from the subterranean reservoir to the terranean surface;

a production tubing string positioned in the wellbore from the terranean surface to the subterranean reservoir and fluidly coupled to the downhole pump, the production tubing string defining an annulus between the production tubing string and the wellbore;

a wellbore seal positioned in the wellbore and configured to fluidly isolate a first portion of the annulus that is uphole of the downhole pump from a second portion of the annulus in which the downhole pump is positionable;

a first pump power cable electrically connected to the motor and to a first power source cable in the first portion of the annulus with a first power connector, each of the first pump power cable and the first power source cable comprising a metal jacket that encapsulates the respective first cable; and a second pump power cable electrically connected to the motor and to a second power source cable in the first portion of the annulus with a second power connector, each of the second pump power cable and the second power source cable comprising a metal jacket that encapsulates the respective second cable, and the second power source cable is electrically coupled to the second pump power cable independently of the first power source cable being electrically coupled to the first pump power cable.

11. The downhole pumping system of claim 10, wherein the power connector comprises a metal-to-metal connector.

12. The downhole pumping system of claim 10, wherein the first pump power cable is electrically connected to the motor at a first motor power connection, and the second pump power cable is electrically connected to the motor at a second motor power connection different than the first motor power connection.

13. The downhole pumping system of claim 10, wherein the metal jacket comprises a stainless steel jacket.

14. The downhole pumping system of claim 10, wherein the metal jacket comprises a plurality of metal jacket sections that are connected to form the metal jacket.

15. The downhole pumping system of claim 14, wherein the plurality of metal jacket sections are threadingly coupled together.

16. The downhole pumping system of claim 15, wherein the wellbore seal positioned in the wellbore and configured to fluidly isolate the first portion of the annulus that is uphole of the wellbore seal and the downhole pump from the second portion of the annulus in which the downhole pump is positionable.

17. The downhole pumping system of claim 10, wherein the wellbore seal positioned in the wellbore and configured to fluidly isolate the first portion of the annulus that is uphole of the wellbore seal and the downhole pump from the second portion of the annulus in which the downhole pump is positionable.

* * * * *